United States Patent [19]

Remmel

[11] 3,958,281

[45] May 25, 1976

[54] TOILET TANK FLUSH VALVE

[76] Inventor: William P. Remmel, 6126 W. Wisconsin Ave., Milwaukee, Wis. 53213

[22] Filed: Mar. 5, 1975

[21] Appl. No.: 555,582

[52] U.S. Cl. ..... 4/67 A; 4/34; 4/37; 4/58

[51] Int. Cl.[2] ..... E03D 1/34; E03D 5/02; A61B 19/00

[58] Field of Search ..... 4/67 A, 57 R, 67 R, 4/34, 37, 58

[56] References Cited

UNITED STATES PATENTS

| | | | |
|---|---|---|---|
| 2,709,263 | 5/1955 | Doty | 4/67 A |
| 2,716,242 | 8/1955 | Robinson | 4/37 |
| 2,940,084 | 6/1960 | Fabbi et al. | 4/34 |
| 3,005,206 | 10/1961 | Dollinger | 4/DIG. 1 |
| 3,151,337 | 10/1964 | Deniz | 4/67 A |
| 3,186,007 | 6/1965 | Falotico | 4/37 |
| 3,758,893 | 9/1973 | Smolinski et al. | 4/34 X |
| 3,869,733 | 3/1975 | White | 4/67 A |

*Primary Examiner*—Henry K. Artis
*Attorney, Agent, or Firm*—Fred Wiviott

[57] ABSTRACT

A toilet tank flush valve having a primary valve element for sealing the tank outlet opening and a secondary valve mounted therein. The secondary valve has a valve seat mounted on the primary valve and a movable valve element which couples the primary valve to the lift rod. Partial elevation of the lift rod opens the secondary valve without opening the primary valve and permits reclosure of the secondary valve for partial emptying of the tank. Full elevation of the lift rod opens the primary valve for complete tank opening.

9 Claims, 4 Drawing Figures

TOILET TANK FLUSH VALVE

BACKGROUND OF THE INVENTION

This invention relates to toilet tank flush valves and more particularly to a flush valve operable for the partial or complete discharge of the tank contents.

Conventional toilet tanks are provided with a bottom drain opening normally closed by a bulbous valve. A lift rod conventionally couples the valve to an operating lever for the elevation of the valve which permits the contents of the tank to discharge. Normally, the closure valve does not become seated in the tank drain opening until all of the contents of the tank have been discharged.

In order to conserve water and power several attempts have been made to minimize the amount of water discharged during each flushing operation. These attempts have normally involved diminishing the water volume in the flushed tank.

SUMMARY OF THE INVENTION

It is a primary object of the invention to provide a flush tank valve which is selectively operable for full or partial tank discharge.

These and other objects and advantages of the present invention will become apparent from the detailed description thereof taken with the accompanying drawings.

DESCRIPTION OF THE PREFERRED EMBODIMENT

Figure 1:
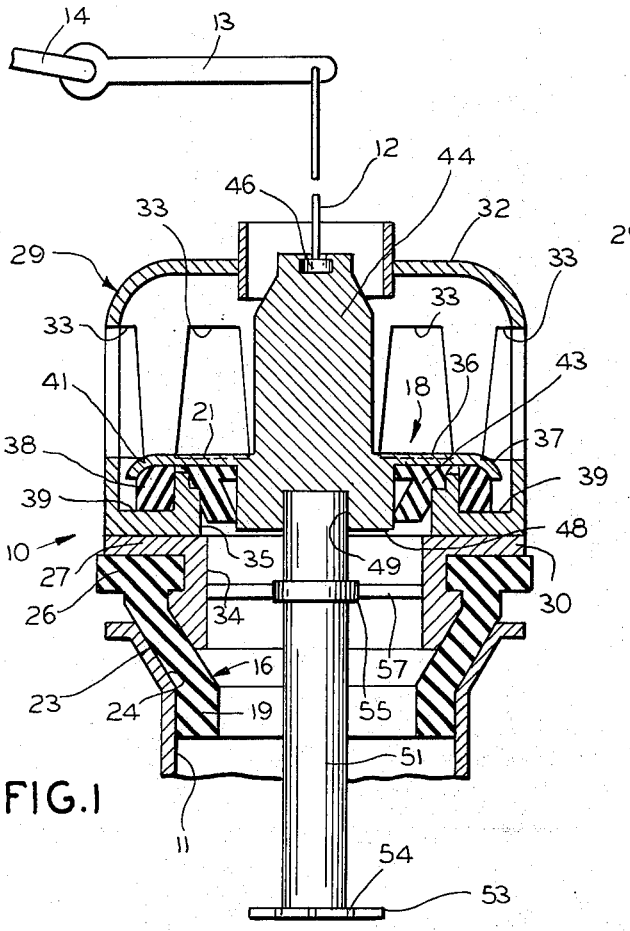
FIG. 1 is a side elevational view, partially in section, of a flush tank valve according to the present invention.

The flush valve 10 according to the present invention shown in FIG. 1 is adapted to be disposed in a conventional toilet flush tank (not shown) which may have a water inlet valve (not shown) normally operable by a float control for shutoff when the tank water level reaches a predetermined level. A flush valve 10 is operable for discharging water from the tank through a main drain outlet 11 under the influence of a lift rod 12 coupled at its lower end to the flush valve 10 and its upper end to a lever 13. An exterior handle 14 is pivotally mounted on the wall of the tank (not shown) and is coupled to the lever 13 whereby counter-clockwise pivotal movement of the handle 14 will move the lift rod 12 vertically for operating the valve 10.

Flush valve 10 according to the present invention includes a primary valve 16 and a secondary valve 18. The primary valve includes an open ended, generally vertically oriented, hollow valve element 19 which seats on the tank drain outlet 11 while the secondary valve includes a valve element 21 which is movable relative to the main valve element 19 for sealing the open upper end thereof. The valve element 19 may be formed of any suitable material, such as rubber, and includes an outer surface 23 conforming generally to the inner surface 24 of the drain 11 which, in the illustrated example, is generally frusto-conical. A generally horizontally extending flange 26 is integrally formed at the upper end of the element 19 for engaging the complimentary outer surface of the hollow open ended body member 27. The valve 10 also includes a hollow bulb member 29 which includes an annular base portion 30 integrally mounted on top of the body member 27 and a hollow shell portion 32 extending upwardly from base portion 30. Generally annular interior surfaces 34 and 35 are formed on the body member 27 and the base member 30, respectively, and define a flow passage with the interior of the valve element 19.

The shell 32 is generally a thin walled, hollow, inverted cup-shaped member integrally formed on the base portion 30 and has a plurality of axially extending slots 33 formed in its vertical side walls. Slots 33 provide a flow path from the exterior of the shell 32 to the interior surfaces of the members 19, 27 and 30 but this flow path is normally closed by the secondary valve 18 when in its position shown in FIG. 1.

Secondary valve 18 includes a disk member 36 whose diameter exceeds that of the inner surface 35 of base portion 30. The outer lip 37 of disk member 36 is turned downwardly for cooperatingly engaging an annular sealing gasket 38 which is supported on an upper planar surface 39 of body member 32. Gasket 38 is also retained in its coaxial position relative to opening 35 by means of a vertically extending collar 41 which extends integrally upward from the inner periphery of body member 30 and which also defines the surface 35.

A second annular gasket 43 is affixed coaxially to the under surface of disk member 34 and has a generally frusto-conical outer surface for sealingly engaging the surface 35. The gaskets 39 and 43 cooperate with the members 30 and 34 to seal the flow passage from the interior of the shell 32 when the element 36 is in its closed position shown in FIG. 1.

Extending upwardly in a generally coaxial relation from the plate 34 is a first plunger 44, the upper end of which is provided with a suitable threaded nut 46 for being coupled to the lower end of the lift rod 12. Integrally formed below the disk element 36 is a generally cylindrical socket portion 48 having an axial bore 49 for receiving the upper end of a guide rod 51 which extends axially downward through the sealing member 19 and into the drain 11 when the assembly is in its closed position shown in FIG. 1. Disposed at the lower end of the rod 51 is a generally disk shaped baffle 53 which has a plurality of radial slots 54. An annular guide ring 55 is supported in surrounding relation to the plunger rod 51 and intermediate its ends by a plurality of radiating support fingers 57 affixed at their outer ends to the surface 34 of body member 27. The upper end of the shell 32 is provided with an annular opening 60 which receives a vertically oriented guide collar 61.

Figure 2:
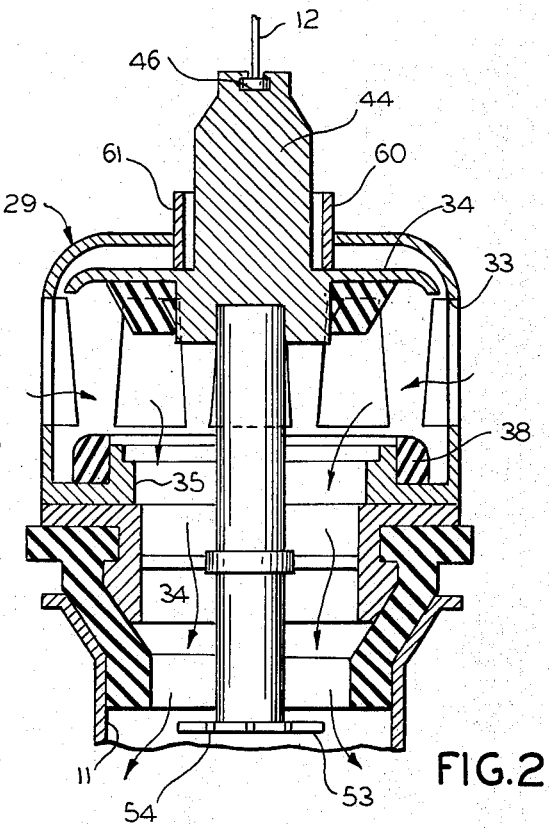
FIG. 2 illustrates the flush valve of FIG. 1 in its partial discharge position.

The assembly is shown in FIG. 1 to be in its closed position wherein the valve element 19 is seated against the surface 24 of the drain 11 and the secondary valve 18 is closed with the outer periphery of the disk member 21 in engagement with the gasket 38 while the gasket 43 is in engagement with the surface 35. When in this position, water is prevented from exiting the flush tank through the drain 11. If it is desired to drain a portion only of the water in the flush tank, the handle 14 is pivoted partially in a counter-clockwise direction to elevate the secondary valve 18 from its position shown in FIG. 1 to its position shown in FIG. 2. This raises the disk member 34 and gasket 43 away from gasket 38 and the internal surface 35 of base 30. Accordingly, water may enter the flow passage defined by the surfaces 35, 34 and the interior of element 19 through the slots 33 formed in the shell 32. So long as the disk 34 is retained in this position, the contents of the flush tank will flow outwardly through the drain 11. However, if only partial emptying of the flush tank is desired, the lever 14 may be released after partial discharge whereupon the water acting on baffle 53 at the lower end of the plunger rod 51 will return the disk member 34 to its closed position shown in FIG. 1. The drain 11 will again be closed and the water level in the flush tank may return to its full position by the action of the inlet valve (not shown).

Figure 3:
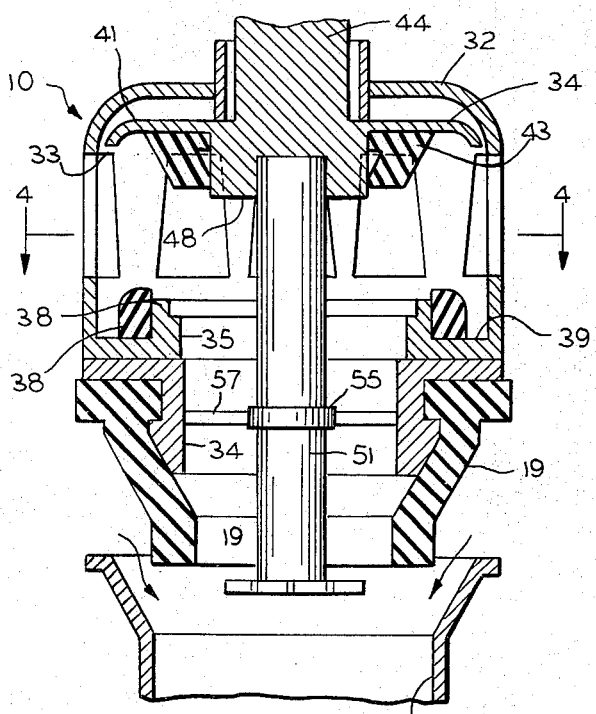
FIG. 3 shows the flush tank apparatus of FIG. 1 in its full open position.
Figure 4:
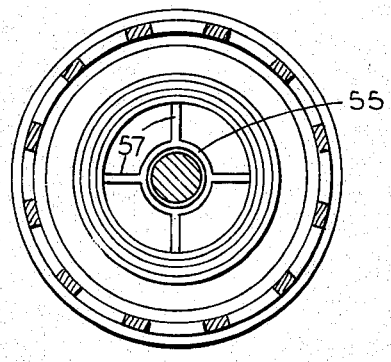
FIG. 4 is a view taken along lines 4—4 of FIG. 2.

If full flushing is desired, the handle 14 is fully pivoted causing the disk 34 to be raised from its position shown in FIG. 1 to its position shown in FIG. 3. It will be appreciated that during this movement, the disk 34 will pass through an intermediate position shown in FIG. 2, at which point, further upward movement of the lift rod 12 will cause the disk 34 to engage the collar 61 so that the cage member 32 begins moving upwardly with the disk 34. This moves the primary valve element 19 away from the drain 11. After the handle 14 is released, the disk 34 may move downwardly under the influence of water on disk 53 until it engages the gasket 39 but the entire valve assembly 10 will remain elevated with the valve element 19 separated from the drain 11 until the contents of the flush tank are substantially discharged in the conventional manner. Finally, when substantially all of the water has passed through the drain 11, the valve element 19 will recede closing drain 11 and permitting the tank to be refilled.

While only a single embodiment of the invention has been shown and described, it is not intended to be limited thereby but only by the scope of the appended claims.

I claim:

1. A flush valve for normally closing a discharge opening and movable away from the discharge opening for discharging the contents of an enclosure, the improvement comprising:

first valve means including a hollow enclosure portion and a first valve element mounted on the lower end of said hollow portion and engageable with said discharge opening, a flow passage formed in said first valve element, a second valve element being mounted within said hollow portion for reciprocable movement into and out of sealing engagement with said flow passage, operating means coupled to said second valve element and being selectively operable for moving said second valve element away from said flow passage, said second valve element being operable to close said flow passage when released from the action of said operating means, said first valve means being operative to close said discharge opening when said flow passage is closed, engageable means coupled to said first valve means and disposed in the path of said second valve element as the latter moves toward its open position, whereby partial movement of said operating means moves said second valve element to its open position and further movement of said operating means engages said second valve element with said engageable means for moving said first valve means away from said discharge opening, means defining at least one opening in said hollow portion for passage of water therethrough when said second valve element is moved a partial distance away from said flow passage, and coupling means formed on the upper end of said second valve element for engaging one end of a lift rod, an opening formed in the upper end of said hollow portion for passage of said lift rod therethrough.

2. The invention set forth in claim 1 wherein said hollow portion has a central opening formed in a lower end thereof, said first valve element being mounted in a sealing relation below said opening, and gasket means mounted on at least one of said second valve element and said hollow portion for sealing said opening when said second valve element is in its closed position.

3. The invention set forth in claim 2 and including a guide plunger mounted below said second valve element and extending downwardly through said first valve element, baffle means mounted at the lower end of said guide plunger for being engaged by water flowing through the opening in said hollow portion when said second valve element is in its open position.

4. The invention set forth in claim 3 wherein said discharge opening includes means defining a valve seat, said first valve element having an outer surface portion conforming to said valve seat for being seated thereagainst when in its closed position.

5. The invention set forth in claim 4 wherein said operating means includes handle means pivotally mounted on said enclosure, lever means coupled to said handle and pivotal therewith, a lift rod coupled at one end to said lever and extending downwardly therefrom for engaging said coupling means.

6. The invention set forth in claim 1 and including a guide plunger mounted below said second valve element and extending downwardly through said first valve element, baffle means mounted at the lower end of said guide plunger for being engaged by water flowing through the opening in said hollow portion when said second valve element is in its open position.

7. The invention set forth in claim 1 wherein said discharge opening includes means defining a valve seat, said first valve element having an outer surface portion conforming to said valve seat for being seated thereagainst when in its closed position.

8. The invention set forth in claim 1 wherein said operating means includes handle means pivotally mounted on said enclosure, lever means coupled to said handle and pivotal therewith, a lift rod coupled at one end to said lever means and extending downwardly therefrom for engaging said coupling means.

9. A flush valve for normally closing a discharge opening and movable away from the discharge opening for discharging the contents of an enclosure, the improvement comprising:

first valve means operative to engage the discharge opening, a flow passage formed in said first valve means, and having an inlet and an outlet below said inlet, second valve means movably mounted for reciprocal movement upwardly away from and downwardly into engagement with said inlet for closing said flow passage, said first valve means being operative to close said discharge opening when said flow passage is closed, operating means coupled to said second valve means and includes a lost motion means coupled to said first valve means whereby said second valve means is moved away from said flow passage upon partial movement of said operating means, and said first valve means is opened upon complete movement of said operating means, said second valve means being operable to close said flow passage when released from the action of said operating means, and an elongate guide plunger mounted below said second valve means and extending downwardly through said flow passage, baffle plate means mounted adjacent the lower end of said guide plunger and extending across a substantial portion of said flow passage for being engaged by water flowing therethrough when said second valve means is in its open position whereby water moving through said flow passage when said second valve means is elevated away from said inlet will exert a downward force on said second valve means tending to close the same.

* * * * *